US005507391A

United States Patent [19]

Rollins

[11] Patent Number: 5,507,391

[45] Date of Patent: Apr. 16, 1996

[54] ROTATABLE AND STACKABLE COSMETIC TURNTABLE WITH COVER

[76] Inventor: Francis C. Rollins, 5531 B St., SE., Washington, D.C. 20019

[21] Appl. No.: 219,521

[22] Filed: Mar. 29, 1994

[51] Int. Cl.[6] ..... B65D 81/02; B65D 21/00

[52] U.S. Cl. ..... 206/581; 206/45.19; 206/503; 206/509; 206/823; 312/305; 220/345

[58] Field of Search ..... 206/45.19, 503, 206/509, 581, 527, 823; 312/305, 249.2, 125; 220/345, 350, 661

[56] References Cited

U.S. PATENT DOCUMENTS

| | | | |
|---|---|---|---|
| 95,477 | 10/1869 | Hinman | 220/345 |
| 160,467 | 3/1875 | Quackenbush | 312/305 |
| 239,237 | 3/1881 | Forncrook | 312/305 |
| 346,166 | 7/1886 | Linnell | 220/345 |
| 1,214,158 | 1/1917 | Hansen | 220/350 |
| 3,695,424 | 10/1972 | Cristy et al. | 206/509 |
| 3,856,178 | 12/1974 | Norgaard | 206/509 |
| 4,191,437 | 3/1980 | Funke | 312/305 |
| 4,660,725 | 4/1987 | Fishman et al. | 206/509 |
| 4,697,856 | 10/1987 | Abraham | 312/305 |

*Primary Examiner*—Paul T. Sewell
*Assistant Examiner*—Marie Denise Patterson

[57] ABSTRACT

A hollow circular container or housing unit, for holding different sized units containing cosmetics and other personal care items. The unit is made of transparent molded plastic and has a removable top. The container is molded with an inwardly facing, thin-walled supporting lip which extends along the inner walls near the top of the container where the top rests. A three armed rotating carriage with free spinning wheels at the end of each arm is held in place by a center post at the bottom of the container. The carriage rotates in place on center post which is located on the bottom of the container. A circular plate rests and revolves on the three-armed carriage. The housing of the container includes a molded opening in order to place cosmetics on the revolving plate. The recessed corner molding connecting circular wall to bottom of housing enclosure fits snugly into the bevelled top rim to create interlocking parts which allows the containers to be stacked.

5 Claims, 5 Drawing Sheets

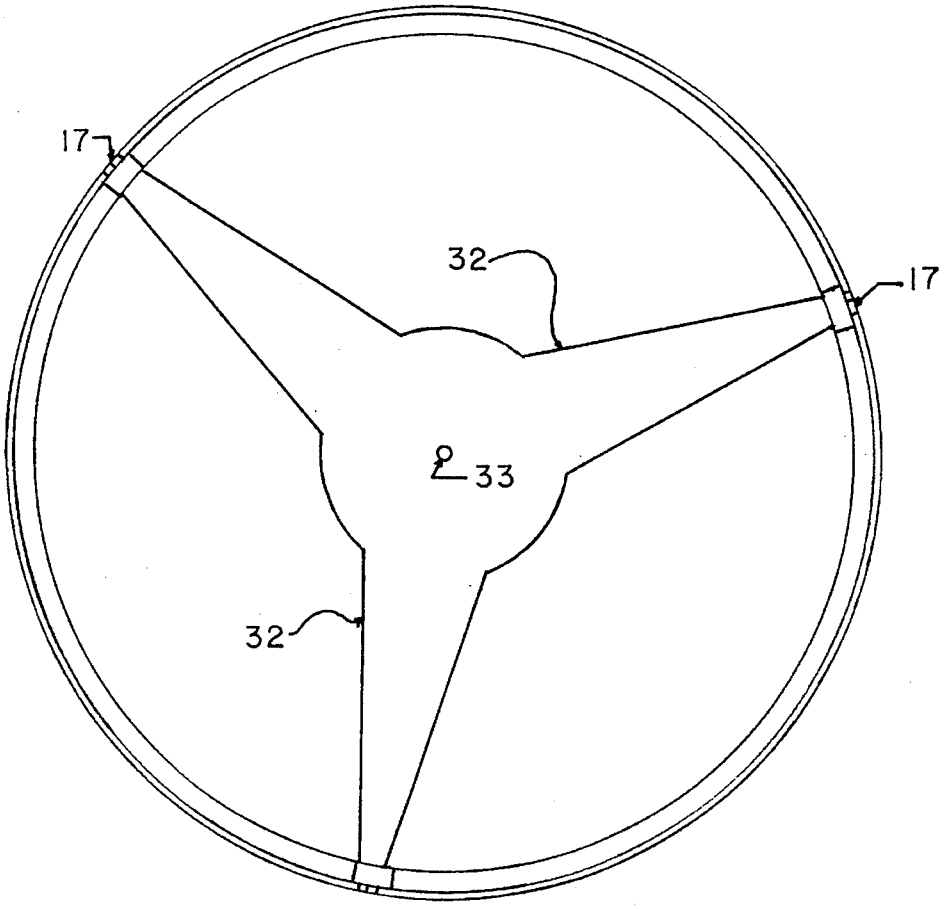
FIG 6
FIG 6A
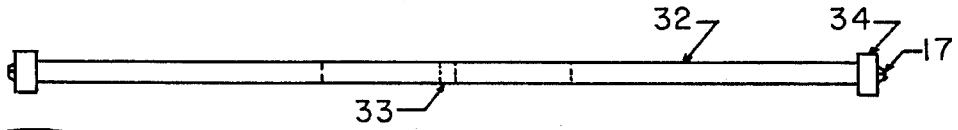
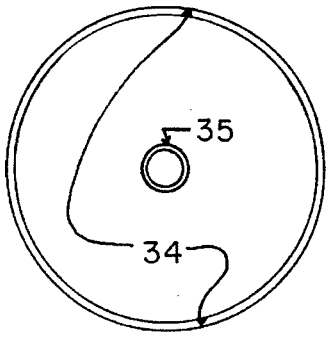
FIG 7
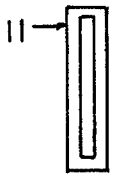
FIG 8

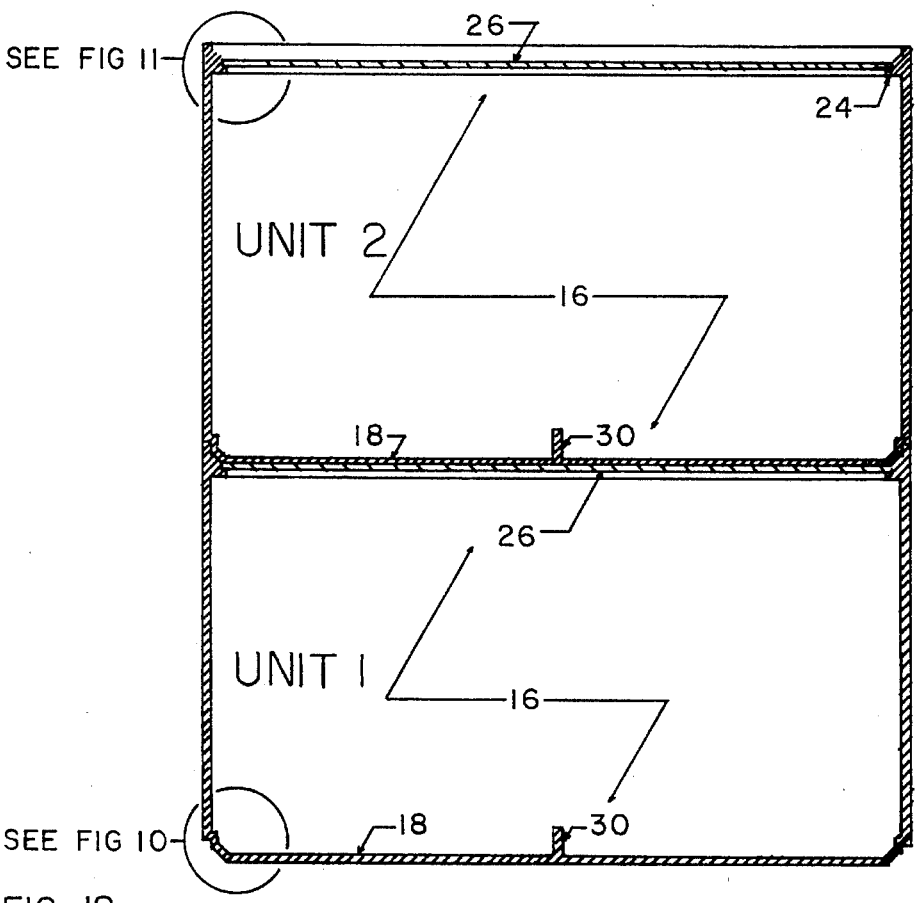
FIG 12
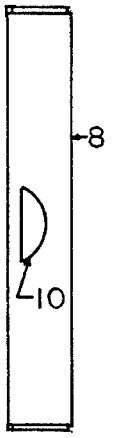
FIG 9
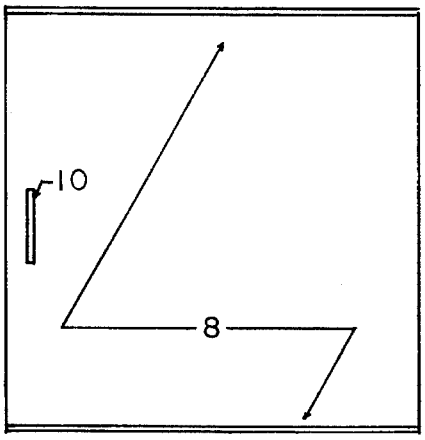
FIG 9A
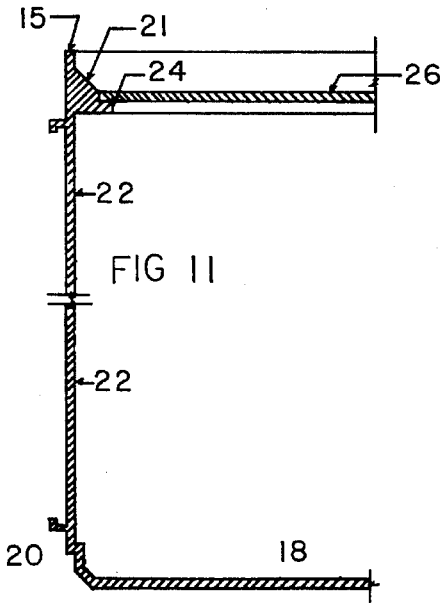
FIG 11
FIG 10
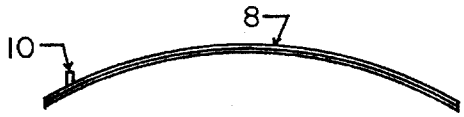
FIG 9B

ROTATABLE AND STACKABLE COSMETIC TURNTABLE WITH COVER

BACKGROUND

1. Field of the Invention

This invention relates to molded plastic containers for housing cosmetics and personal care items, such as cologne, after shave, perfume, face powder, face cream, and the like.

2. Description of the Related Art

Heretofore numerous types of organizers and storage units, both molded and metal, have been proposed and produced in which cosmetic products in their containers are housed. In most cases, the storage capability of such units is limited both internally and externally. Internally, past units have organized cosmetics through sectional dividers. Such an approach may seem advantageous in theory but, in practice, the users eventually find themselves abandoning sectional assignments in favor of expedient storage, the end result being a disorganized collection of arbitrary cosmetics. Externally, past units have been designed to horizontally stand alone. This design has prohibited users from making the best use of vertical space, which has created an overall problem of storage space for the units themselves.

SUMMARY

The above drawbacks and disadvantages of prior storage units having internal sectional dividers and a stand alone design are obviated by the present invention, which has for its main object the ability to vertically store cosmetics without sectional and visual hindrances. This object is accomplished by providing a molded hollow transparent plastic container with a circular form, a bevelled upper rim, a recessed bottom wall, a three-pronged wheel frame affixed to the bottom upon which a plastic plate is placed and a square shaped opening centrally located in the circular wall upon which a sliding door is attached. The door provides easy access to the inner contents of the container without movement of the container. Once accessed through the central opening, the plate allows the user easy access to desired cosmetics through rotation. All the while, total ease of identification of desired cosmetics is guaranteed through the complete transparency of the unit. Further, and probably most advantageously, entire units may be stacked one upon the other, plate in each unit rotates independently of the others hereinafter be described.

BRIEF DESCRIPTION OF THE DRAWINGS

FIG. 6 and FIG. 6A are top and front view of a carriage (three armed rotating carriage) 32; exposed part of axle 17; a center hole (for center post) 33; and wheels (for carriage) 34.

FIG. 7 is an elevated view of the wheel (for carriage) 34; and an axle hole (in center of wheel) 35. FIG. 8 is a side view of the sliding door stop 11.

FIG. 9, FIG. 9A, and 9B show elevated and side view of a sliding door 8; and a sliding door handle 10.

FIG. 10 is an enlarged fragmentary sectional view of a bottom of housing enclosure 18; a recessed corner mold in connecting circular wall to bottom of a housing enclosure (male) 20; and a circular wall of housing enclosure 22.

FIG. 11 is an enlarged fragmentary sectional view of a topmost surface of a housing enclosure 15; a recessed corner molding at the top of an enclosure (female) 21; a circular wall of a housing enclosure 22; and a supporting lip for a removable top 24.

FIG. 12 is an elevated view showing two stacked units.

DESCRIPTION OF THE PREFERRED EMBODIMENTS

Figure 3:
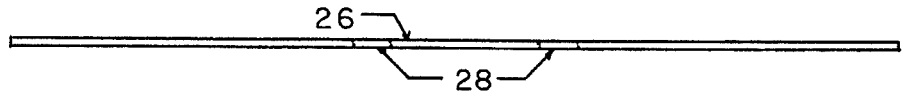
FIG. 3 is an elevated removed view of the circular top (removable).
Figure 2:
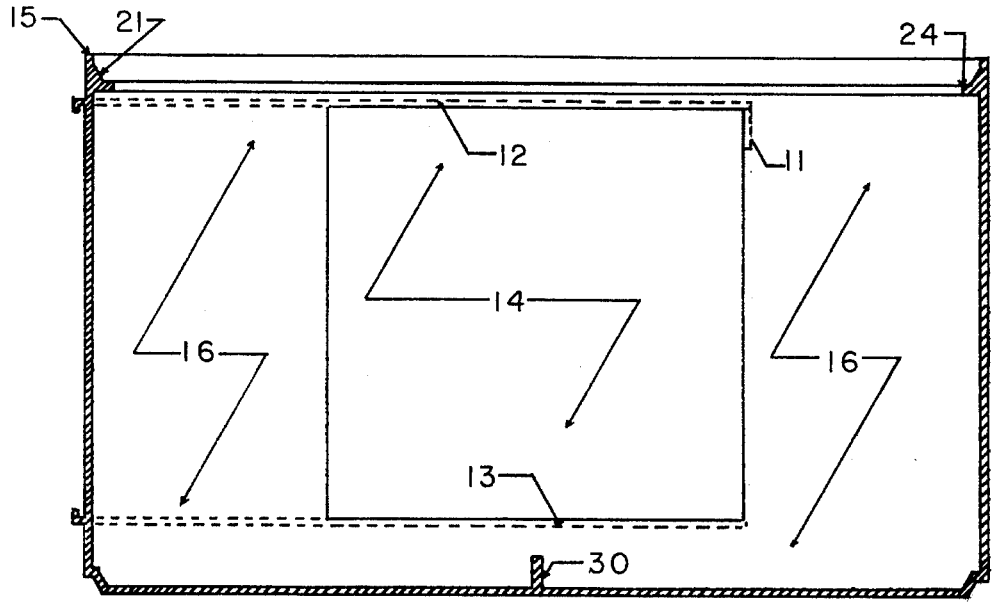
FIG. 2 is a cross section of housing enclosure 22 showing a sliding door stop 11; a sliding door track (top) 12; a sliding door opening 14; a topmost surface of housing enclosure 15; housing enclosure 16; a bottom of housing enclosure 18; a recessed corner molding connecting a circular wall to a bottom of housing enclosure (male) 20; a recessed corner molding at the top of an enclosure (female) 21; a circular wall of a housing enclosure 22; a supporting lip for removable top 24; and a center post 30.
Figure 1:
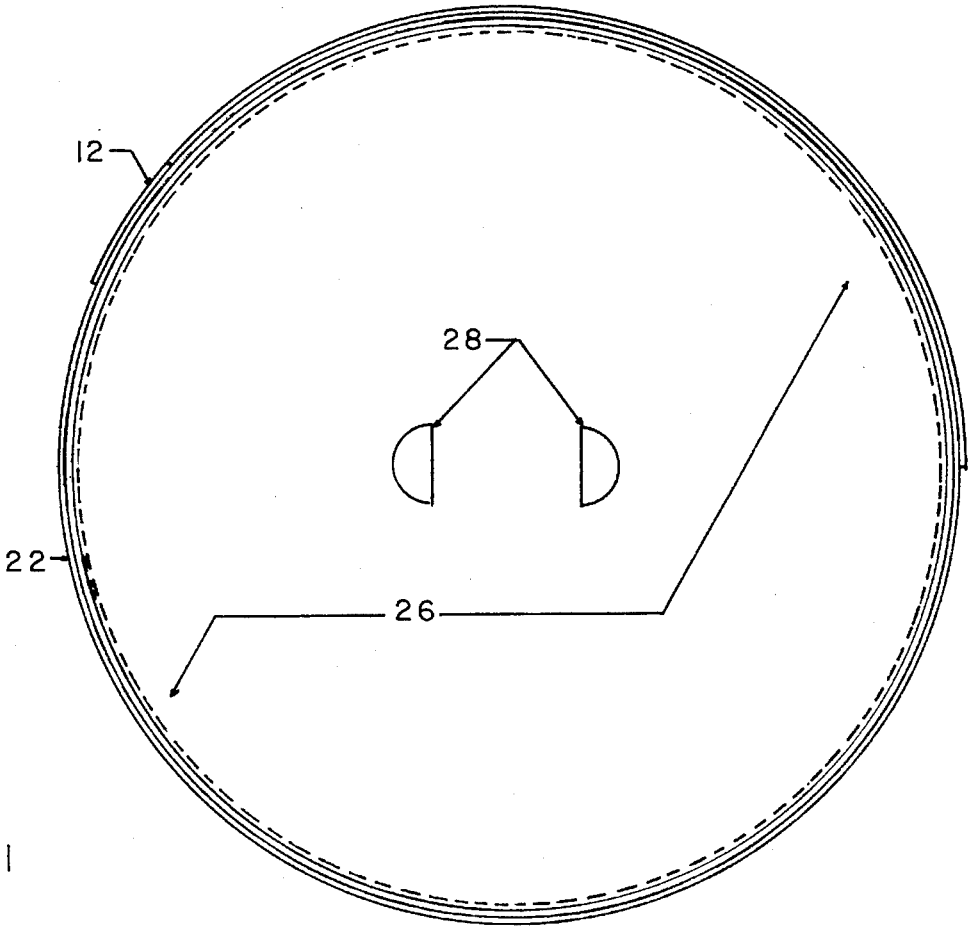
FIG. 1 is a view showing a circular top (removable) 26, finger holes for removal of a top 28 and a circular wall of a housing enclosure 22.
Figure 4:
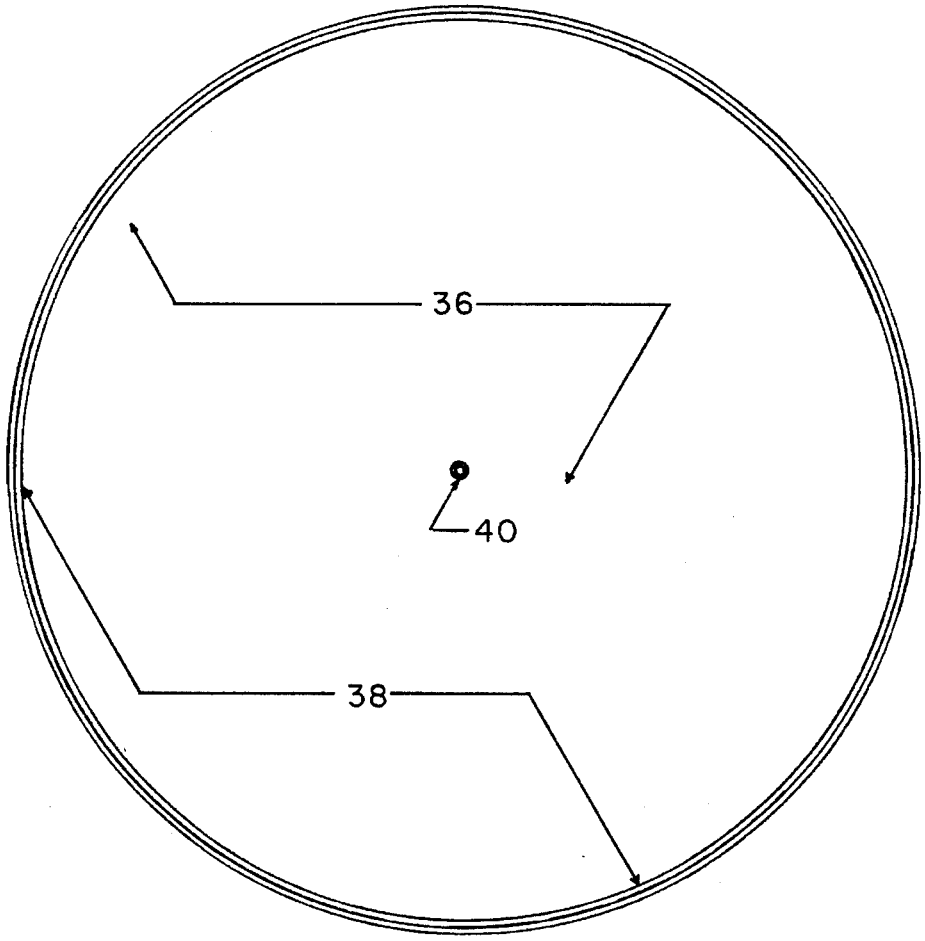
FIG. 4 and FIG. 4A are bottom and sectional view of a plate (rotating) 36; a plate wheel guide 38; and a center seat (under rotating plate) 40.
Figure 4A:
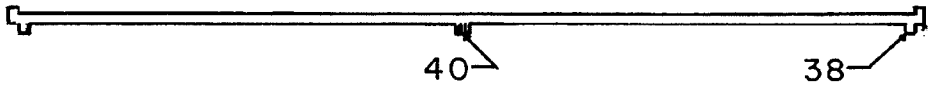
Figure 5:
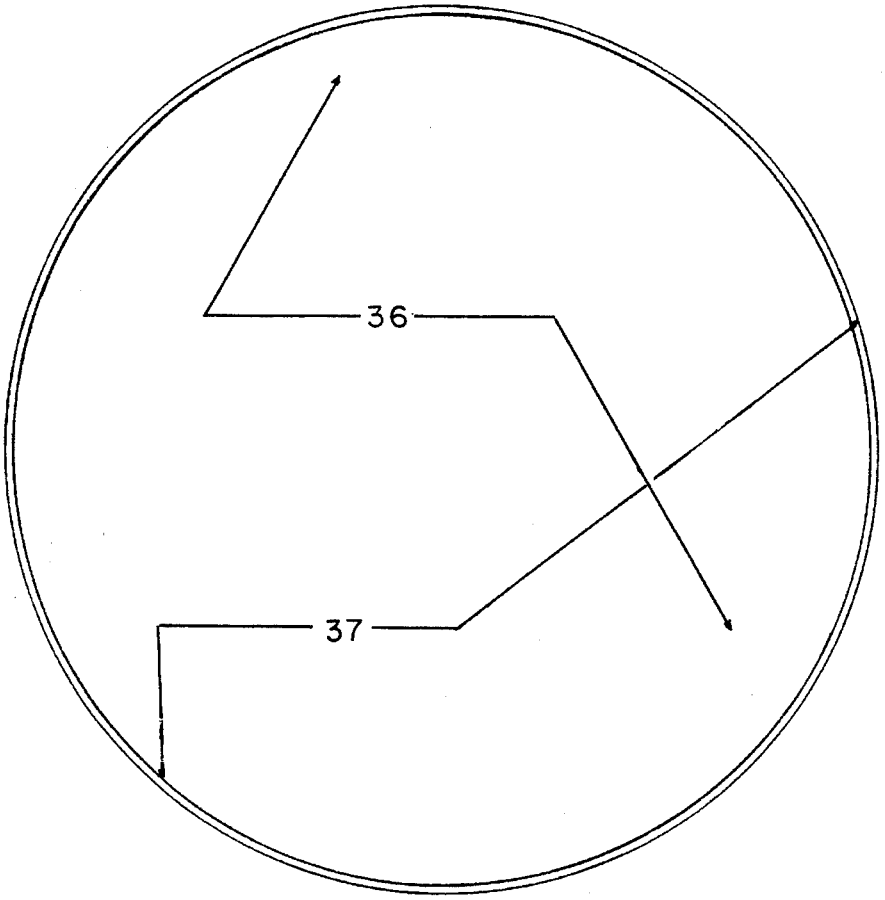
FIG. 5 and 5A are top and sectional view of a plate (rotating) 36; and a plate top outer lip 32.
Figure 5A:
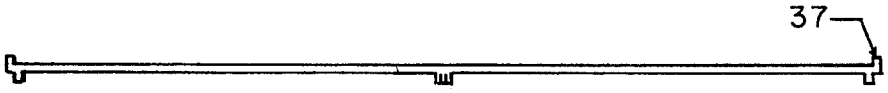

Considering FIGS. 2, 10, 11 and 12 shown. Therein includes a housing enclosure designated generally by the numeral 16. The housing enclosure portion having the form of a hollow circular container with a recessed corner molding 20 connecting a circular wall 22 to a bottom 18 of the housing enclosure 16, a recessed corner molding 21 at a top of enclosure 16, as seen in FIGS. 10 and 11. The recessed corner molding 20 connecting the circular wall 22 to the bottom 18 of housing enclosure 16. Hence the bottom 18 with melding 20 will fit perfectly on top of molding 21 allowing several containers to be stacked one above another as illustrated in FIG. 12 resting on a top most surface of housing enclosure 16 as well as molding 21. As seen in FIGS. 2 and 11, the housing enclosure 16 is molded with a supporting lip 24 for a removable top 26, where lip 24 extends along the inner wall near the top of the container 16. As seen in FIGS. 1, 3 and 11, the circular top 26 is molded with dual finger holes 28. The top 26 rests securely on lip 24, of the housing enclosure 16. As shown in FIG. 2 the enclosure 16 is molded with a top sliding curved door track 12 and a bottom sliding curved door track 13, and acts as a guide and track for a sliding door 8. The door 8 fits the inside curved surface of these tracks 12 & 13 sliding open to gain access to container inside. The door 8 is molded with an outwardly protruding handle 10 which, when grasped by the fingers, is used to move the door 8 left to right. Considering FIG. 2, a sliding door stop 11 is positioned vertically at the extreme left end of sliding door track 12 to keep the sliding door 8 from coming out of its tracks 12 & 13. Considering FIGS. 2 & 6, a three armed rotating carriage 32 rotates on wheels 34 while resting on the bottom 18 of housing 16, and fits on a center post 30 located under a rotating plate resting on carriage 32. As seen in FIGS. 4 & 5, a plate 36 fits on center post 30 protruding through carriage 32 into a center seat 40 on the under side of the plate. The plate 36 includes a plate wheel guide 38 protruding downward on underside of plate 36, and plate top outer lip 37 which keeps objects from sliding off of the plate. Plate lip 37 and guide 38 extend around the top and bottom perimeter. The plate 36 is placed on wheels 34 with center post 30 fitting in center seat 40 allowing plate 36 to be rotated by hand. It will be seen that by the above construction this is an extremely practical, accessible and space saving way to store cosmetic products. Attached to the very light and conveniently transparent housing 16 is a sliding door 8 allowing easy access to rotating plate 36. Further, recesses 20 allow a snug fit upon bevelled edge 21 for convenient elevational multiple storage capability.

MANUFACTURING OUTLINE

The unit is made of a clear transparent plastic. Injection molding makes the six (6) individual parts. All parts are made of the same transparent material. The parts are all assembled as a whole at the time of manufacture. One complete unit consists of:

(1) continuous molded outer shell; the part acts as the master housing unit to which all other parts are attached;

(2) a molded top circular piece with two (2) finger holes for easy removal; Purpose: this part is for easy access in case of interior clean up due to spillage;

(3) a molded sliding door put in place at the time of manufacture on the vertical outer wall; this door slides along an exterior, horizontal track molded with the housing; this door has an extrued molded finger grip; Purpose: this door will allow access to the rotatable turntable without removing the unit stacked on top;

(4) a molded three armed rotating carriage frame set in place at the time of manufacture; this carriage rotates on a center post; Purpose: the carriage acts as the place to sit the rotating turntable plate;

(5) a molded turntable plate set in place at the time of manufacture; the turntable has a smooth surface with molded outer lips top and bottom; the lips keep the plate in place while rotating and keep items on the turntable; the purpose of the turntable is a place to put various sized containers containing cosmetics and other personal care items; the turntable, in conjunction with the sliding door, will allow access to any item in any position on the turntable; to gain access to the turntable while stacked, slide door open, insert hand in opening, turn table with hands to position of desired item and remove item.

(6) the molded three plastic wheels are placed on the end arms of each of the three (3) arms of the carriage at the time of manufacture; the purpose of the wheels is to allow three (3) carriage frames to rotate freely with plate and to stabilize the plate when unevenly loaded.

I claim:

1. A stackable hollow container for holding cosmetic products, comprising a molded, transparent plastic container having a top inner rim of a circular wall molded at an inward slope, creating a bevelled edge, a shoulder having a thin wall, protruding from the circular wall and extending along an inner side of the wall of the container, below the bevelled edge, a central square shaped opening in the wall, and an upper track and a lower supporting track and a bevelled bottom rim; a transparent plastic turntable resting in said container; and a molded sliding transparent door with an outwardly protruding handle and being supported by the tracks.

2. A unit container as in claim 1, further comprising a top molded with dual semicircular finger holes straddling a center thereof and resting securely on the top inner rim.

3. A container as in claim 2, further comprising a rotating frame fixed to the bottom on an inside of the wall and having a free turning plastic wheel fastened around end arms.

4. A container as in claim 3, further comprising a plastic plate rotating within the container and molded with an outwardly protruding thin-walled shoulder extending around an upper perimeter of the plate.

5. A stackable unit for holding small cosmetic objects, comprising: a transparent plastic rotating turntable upon which the small objects sit, said turntable comprising a plate resting on wheels and having an upwardly protruding rim preventing the small objects from sliding off the plate; a plastic, transparent, cylindrical, walled container surrounding said turntable, having a wall side opening through which the small objects can be reached, a shoulder extending inward of said container, a track in the wall and a bevelled bottom; a plastic transparent door slidably resting in the track, slidably covering the opening and having a handle; and a transparent plastic, bevelled, transparent top resting on the shoulder, into which said container fits when units are stacked, and having finger holes used to lift said top when removing said top.

* * * * *